US005679420A

United States Patent [19]

Taguchi et al.

[11] Patent Number: 5,679,420

[45] Date of Patent: Oct. 21, 1997

[54] POLYMER RESIN PACKAGING MATERIAL FOR PHOTOGRAPHIC LIGHT SENSITIVE MATERIAL

[75] Inventors: Masahiko Taguchi; Katsunori Goi; Hitoshi Ohkubo, all of Hino, Japan

[73] Assignee: Konica Corporation, Tokyo, Japan

[21] Appl. No.: 577,326

[22] Filed: Dec. 22, 1995

[30] Foreign Application Priority Data

Dec. 27, 1994 [JP] Japan ..... 6-324901

[51] Int. Cl.[6] ..... B65D 85/84

[52] U.S. Cl. ..... 428/34.1; 206/524.1; 206/524.6

[58] Field of Search ..... 525/240; 428/34.1; 206/524.1, 524.6

[56] References Cited

U.S. PATENT DOCUMENTS 5,266,392 11/1993 Land et al. ..... 428/224

FOREIGN PATENT DOCUMENTS 0 538 749 4/1993 European Pat. Off. .

0 588 667 3/1994 European Pat. Off. .

*Primary Examiner*—Charles Nold

*Attorney, Agent, or Firm*—Finnegan, Henderson, Farabow, Garrett & Dunner, L.L.P.

[57] ABSTRACT

A polymer resin packaging material for a photographic light sensitive material is disclosed, the packaging material comprising at least one heat seal layer consisting of a polymer resin prepared by polymerizing an ethylenically unsaturated monomer in the presence of a metallocene catalyst, the polymer resin containing a lower molecular weight polymer in an amount of 3 weight % or less.

2 Claims, 1 Drawing Sheet

POLYMER RESIN PACKAGING MATERIAL FOR PHOTOGRAPHIC LIGHT SENSITIVE MATERIAL

FIELD OF THE INVENTION

The present invention relates to a polymer resin packaging material for a photographic light sensitive material, and more specifically to a polymer resin packaging material for a photographic light sensitive material having excellent storage stability of the photographic light sensitive material.

BACKGROUND OF THE INVENTION

In the field of photographic light sensitive materials, heretofore, various packaging methods have been adopted for each product type from the viewpoint of keeping the quality of the product.

For example, a 135 size film, which is the most common type, is inserted into a light-shielding container, and then, further inserted in a moisture-proof container or an envelope. In the case of 110 size film, too, the same method is adopted.

Rolls of 120 and 220 size film, are wound integrally with a light-shielding paper on an axis, and then, inserted in a moisture-proof envelope and heat-sealed tightly.

Medical X-ray film and graphic art film are, in the same manner, inserted in a moisture-proof envelope and heat-sealed tightly.

Generally, photographic light-sensitive material is manufactured by coating and drying a coating solution wherein silver halide grains are dispersed in gelatin on a plastic film or a paper substrate covered with a resin film. Therefore, when stored under high humidity conditions, the coating layers containing gelatin absorb moisture. This results in fluctuating photographic performance so that it is difficult to maintain acceptable performance.

Naturally, under normal storage conditions, complete light-shielding is essential so that the film is not exposed to light.

As stated above, in order to store the photographic light sensitive material, a packaging material and a packaging method with (1) high dehumidifying property and (2) high light-shielding property are essential.

In order to keep the above-mentioned conditions, it is the current method to use a material serving a light-shielding function and a dehumidifying function by tight heat-sealing and thereby enhancing storage stability.

Dehumidifying materials for photographic light sensitive material are disclosed in Japanese Patent Publication No. 2700/1990, Japanese Patent Publication Open to Public Inspection (hereinafter, referred to as Japanese Patent O.P.I. Publication) Nos. 111242/1985, 151045/1985, 54934/1986, 189936/1986, 18546/1987, 18548/1987 and 124946/1987, Japanese Utility Publication Open to Public Inspection Nos. 127544/1987 and 184549/1987 and Japanese Patent O.P.I. Publication Nos. 195042/1989, 209134/1989, 64537/1990, 119349/1991, 125139/1991, 196238/1990 and 146539/1990. In all cases, dehumidifying materials for photographic light sensitive material excellent in terms of physical strength, low temperature sealing property, pin puncture resistance property, light-shielding property and envelope forming property, all of which are necessary for a dehumidifying envelope, are cited. When the above-mentioned dehumidifying materials are used for tightly sealing a light sensitive material, heat sealing methods such as heat plate adhesion methods, impulse adhesion methods, melting adhesion methods, ultrasonic adhesion methods and high frequency adhesion methods are necessarily used. Depending upon the style of the envelope, any conventional style such as a gazette envelope, a plain envelope, a corner-bottom envelope and a self-standing envelope can be used, as necessary.

In the above-mentioned situation, depending upon the combination of the dehumidifying material used and the photographic light sensitive material, fogging frequently occurs, though the exact cause is not yet known. Specifically, in the case of bottom-portion gazette envelopes having a thick heat-sealed portion, heat seal is provided on the thick portion. In other words, considerable amount of heat is provided there. Therefore, fogging frequently occurs. In the case of a single material being used for the dehumidifying material, fogging does not occur at all. However, when the envelope is heat-sealed tightly, fogging may occur. The present inventors laboriously studied the cause of such fogging. As a result, it was determined that the temperature of the heat sealing process has a direct relationship to the occurrence of fogging. Namely, the higher the temperature of heat sealing, the more frequently fogging occurred. It is assumed that some harmful gases were also produced at high temperature.

Accordingly, when the temperature of the heat seal is reduced, possibility that the fogging occurs is solved. However, in this occasion, insufficient adhesion of the heat seal portion occurred. As a result, dehumidifying property is deteriorated so that, when the photographic-light sensitive material was stored under this condition, deterioration of photographic performance resulted.

In the same manner as above, in the case of a resin cartridge housing the 110 size film, when the cartridge is assembled, a film is inserted into the cartridge, and then, the cartridge is assembled by melting an adhesive agent by means of ultrasonic for obtaining the light-shielding property. In this case too, when the packaging material is a single material, fogging never occurs. However, when the cartridge adhesive seal is melted and closed tightly, fogging occurs. In this case too, it was discovered that the occurrence of fogging has a direct relationship with melting conditions. Namely, the higher the melting temperature, the more frequently fogging was generated. This cause is assumed to be that some harmful gas was produced. In this case too, when the melting temperature is reduced, the problem of fogging was solved. However, the melted joint was weak. Therefore, when a camera is dropped, the melted portion peels off so that the film is exposed to light. Therefore, this is not a desirable countermeasure.

In order to prevent the above-mentioned problem, currently, the photographic light sensitive material is packaged while controlling adhesion strength and conditions for reducing fogging phenomenon of the photographic light, sensitive material. Therefore, currently, it is desired to develop a polymer resin packaging material for the photographic light sensitive material wherein it is not necessary to consider the adverse influence on the above-mentioned photographic light sensitive material and only adhesion strength needs to be controlled.

SUMMARY OF THE INVENTION

An object of the present invention is to provide a polymer resin packaging material for a photographic light sensitive material wherein the performance of the photographic light sensitive material packaged therein does not occur.

DETAILED DESCRIPTION OF THE INVENTION

The above problems of the invention can be solved by the following:

Figure 1:
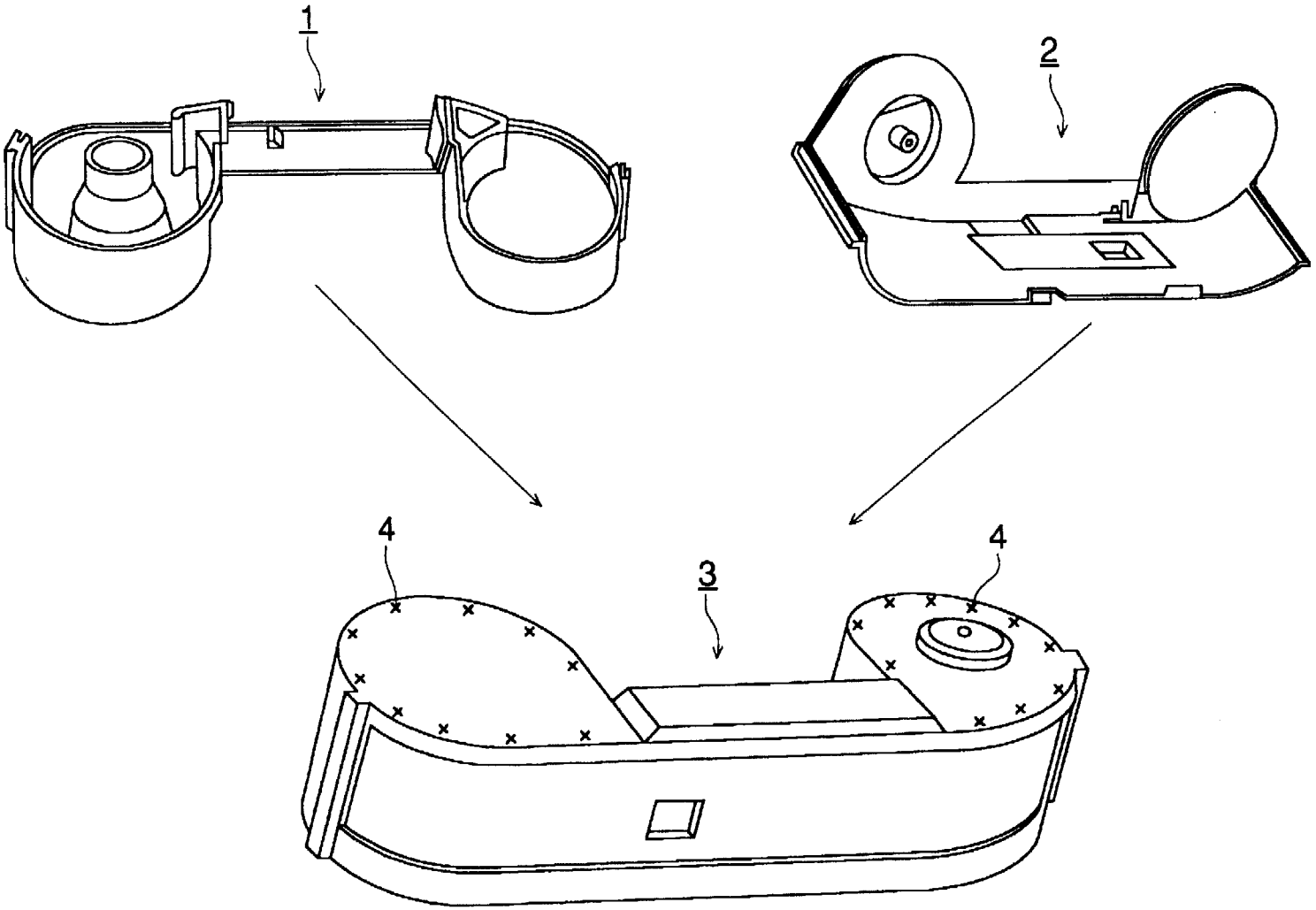
FIG. 1 is an assembly perspective view of the 110 cartridge.

1. A polymer resin packaging material for a photographic light sensitive material, the packaging material being made of a polymer prepared by using a metallocene catalyst.

2. A polymer resin packaging material for a photographic light sensitive material, wherein the packaging material contains a lower molecular weight polymer in an amount of 3 weight % or less.

3. The polymer resin packaging material for a photographic light sensitive material of 1 above, wherein the packaging material contains a lower molecular weight polymer in an amount of 3 weight % or less.

4. A polymer resin packaging material for a photographic light sensitive material, the packaging material comprising at least one heat seal layer consisting of a polymer resin prepared by polymerizing an ethylenically unsaturated monomer in the presence of a metallocene catalyst, the polymer resin containing a lower molecular weight polymer in an amount of 3 weight % or less.

The invention will be described below.

The lower molecular weight polymer in the invention refers to a polymer whose molecular weight is not more than 40,000.

The molecular weight herein is a weight average molecular weight obtained by measuring according to Gel Permeation Chromatography (GPC) method. Herein, the range of the lower molecular weight is different depending upon different polymer resins.

In the invention, the lower molecular weight in polyethylene is preferably 30,000 or less, the lower molecular weight in polypropylene is preferably 40,000 or less, and the lower molecular weight in polystyrene is preferably 20,000 or less.

The container for a photographic light sensitive material is generally divided into three kinds, a container in which a film is tightly heat-sealed, a cartridge in which a film is packaged by fusibly sealing and a molded material such as a camera for a film with lens.

The present inventors have made a study of the relations between heat seal temperature and fog regarding a conventional polymer prepared by using a Ziegler-Natta catalyst and have found that the higher the content in a material of lower molecular weight polymers such as a polyethylene resin having a molecular weight of not more than 30,000, a polypropylene resin having a molecular weight of not more than 40,000 and polystyrene resin having a molecular weight of not more than 20,000 is or the higher the heat seal temperature, the higher fog is caused. When the content in a material of the lower molecular weight polymer is 3 weight % or more, fog is caused. When the content in a material of the lower molecular weight polymer is 3 weight % or less, fog is not caused. The reason is not clear. Probably, when high heat seal temperature is applied, the lower molecular weight polymer complexly decomposes and gas is produced in the sealed package whereby fog is caused. This also applies to a molded case.

The resin used in the invention is prepared using a metallocene catalyst. The typycal resin example includes polyolefins (such as high density polyethylene (HDPE), low density polyethylene (LDPE), straight-chained low density polyethylene (LLDPE), polypropylene (PP)), and polystyrenes (such as polystyrene). The metallocene herein referred to is a complex compound in which a transition metal is sandwiched between unsaturated cyclic compounds. A combination of a Zr complex and methylalumoxane (MAO) is known as the metallocene catalyst.

This catalyst is also called a Kaminsky catalyst or Kaminsky-sinn catalyst.

Kaminsky catalyst is as follows:

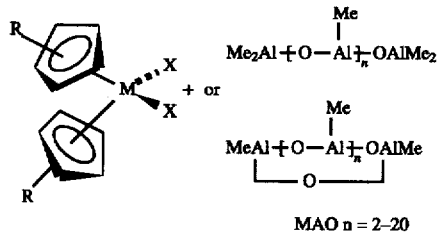

wherein M represents a transition metal; X represents a halogen atom; R represents an alkyl group or an aryl group; and n represents an integer of 2 to 20.

Examples of the metallocene catalyst are shown below.

1

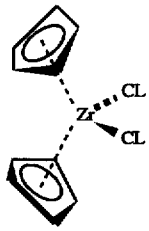

2

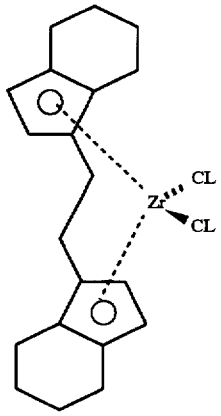

3

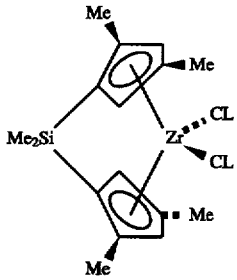

-continued

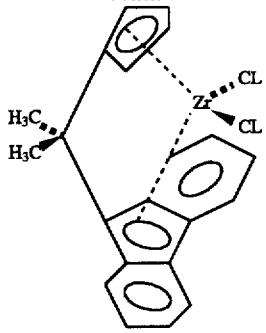

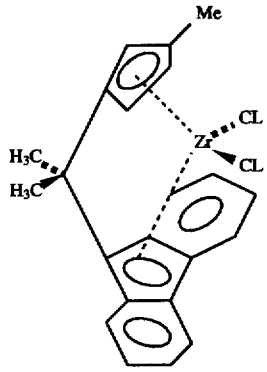

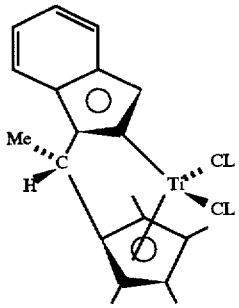

Examples of methylalumoxane are shown below.

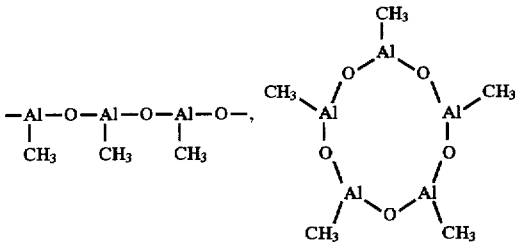

The polymer resin in the invention is prepared by polymerizing an ethylenically unsaturated monomer in the same manner as a conventional polymerization method, except that the metallocene catalyst is used instead of a conventional Ziegler-Natta catalyst.

When a film resin material prepared using a metallocene is used as a heat seal layer, as a flexible layer provided on the heat seal layer conventional films such as polyethylene resins, ethylene copolymer resins, polypropylene resins, propylene.α-olefin copolymer resins, polyvinylchlorides, polyvinylidenechlorides, polyamides, polycarbonates, polystyrenes, polyesters or modified resins thereof or mono or bi axial orientation film thereof are cited. The films also include a metal thin layered film (such as an aluminium vacuum deposited film), cellulose acetate film, cellophane, regenerated cellulose, polyvinyl alcohol, synthetic paper, a metal foil (such as an aluminium foil), non woven fabric cloth and paper (such as non-bleached paper, half-bleached paper, bleached paper, twist paper, CL-pack paper, Duostress paper, white paper board, raw paper for photography, white roll paper, coated paper, simili paper, glassine paper).

These flexible sheets can be used singly or in combination. The melting point of these flexible sheets is preferably not less than 10° C. higher that of material of the heat seal layer.

As a means for covering the above-mentioned flexible layer, various methods can be applied depending upon the application. For example, the flexible layer can be formed by the use of a multi-layer extruding inflation method, an extruding lamination method, a dry lamination method, a processing method described in Convertec, January, 1991, Lamination Primary Lecture (9) pp. 10 through 14, Convertec May, 1990, and extrusion molding of plastic and its varied applications, published by Seibundoh, pp. 137 through 147, and methods described in Handbook on Plastic, published by Asakura Shoten, P. 727, can be used. When the flexible layer is covered by the use of a dry lamination method, any adhesive agent used can be selected from Convertec March of 1993, Lamination Primary Lecture (23) pp. 40 through 48. Of these, as an adhesive agent which does not have adverse influence on photographic performance, ester and urethane are specifically cited.

In order to manufacture a resin by the use of a metallocene catalyst and obtain a molded product by the use of a resin of low molecular weight polymer content of 3% or less, the resin may be manufactured by any conventional multi-unit-manufacturing injection molding method. There is no practical limit to the injection molding method. For example, a hot runner type conventional injection molding method, an inside-molding vacuum injection molding method and a stack mold method may be used.

Specifically, a hot runner type is preferable in terms of molding efficiency.

To the resin used in the present invention, various additives may be added as necessary.

The carbon black for light shielding used in the invention has a sulfur content of preferably 0.5 weight % or less in order not to have an adverse effect on photographic properties. The carbon black available on the market is given below.

| Trade Name | Sulfur Content(wt %) |
|---|---|
| #45 produced by Mitsubishi Kasei Co., Ltd. | 0.5 |
| #950 produced by Mitsubishi Kasei Co., Ltd. | 0.4 |
| Bulkane produced by Cabott Co., Ltd. | 0.2 |
| Denka produced by Denka Co., Ltd. | 0.02 |

The amount of the carbon black added is preferably 0.3 to 0.6 weight %, and more preferably 0.35 to 0.40 weight %. When the content of carbon black is 0.7 weight % or more, film strength is poor, and when the content of carbon black is 0.3 weight % or less, light shielding ability is insufficient and not preferable.

Besides the above, other additives can be optionally added.

The additives are as follows:

Slipping agents (1) Silicone slipping agents

Various dimethylpolysiloxane (such as Sinetsu silicone, Toray silicone)

(2) Oleic amide slipping agents

Armo-slip CP (produced by Lion Akuzo Co., Ltd.), Newtron (produced by Nihon Seika Co., Ltd.), Newtron E-18 (produced by Nihon Seika Co., Ltd.), Amide O (produced by Nitto Kagaku Co., Ltd.), Alflow E-20 (produced by Nihon Yushi Co., Ltd.), Diamide O-200 (produced by Nihon Kasei Co., Ltd.), Diamide G-200 (produced by Nihon Kasei Co., Ltd.)

(3) Erucic amide slipping agents

Alflow P-10 (produced by Nihon Yushi Co., Ltd.)

(4) Stearic amide slipping agents

Alflow S-10 (produced by Nihon Yushi Co., Ltd.), Newtron 2 (produced by Nihon Seika Co., Ltd.), Diamid 200 bis (produced by Nihon Kasei Co., Ltd.)

(5) Bis fatty acid amide slipping agents

Bis amide (produced by Nihon Kasei Co., Ltd.), Diamid 200 bis (produced by Nihon Kasei Co., Ltd.), Armo wax (produced by Lion Akuzo Co., Ltd.)

(6) Alkylamine slipping agents

Electro stripper TS-1 (produced by Kao Co., Ltd.)

(7) Carbon hydrate slipping agents

Liquid paraffin, natural paraffin, Microwax, synthetic paraffin, polyethylene wax, polypropylene wax, chlorinated carbon hydrate, fluorocarbon (8) Fatty acid slipping agents Higer fatty acid (preferably having 12 or more carbon atoms), oxy fatty acid (9) Ester slipping agents Ester of a lower alcohol with fatty acid, ester of a polyhydric alcohol with fatty acid, ester of a polyglycol with fatty acid, ester of a resin alcohol with fatty acid

(10) Alcohol slipping agents

Polyhydric alcohol, polyglycol, polyglycerol

(11) Metal soaps

Compounds of higher fatty acids such as lauric acid, stearic acid, ricinoleic acid, naphthenic acid and oleic acid with metals such as Mg, Ca, Sr, Ba, Zn, Cd, Al, Sn, and Pb. The conductive substance is preferably added to prevent electrostatic defects. The typical examples of the Conductive substance are listed will be shown below.

1) Nonionic surfactants (polyoxyethylene glycols as typical components)
2) Anionic surfactants (polyoxyethylene glycols as typical components)
3) Cationic surfactants (quaternary ammonium salts as typical components)
4) Amphoteric surfactants
5) Alkylamine derivatives
6) Fatty acid derivatives
7) Various lubricants
8) Carbon black, Graphite
9) Metal surface coating pigment
10) Metal powder, metal flake
11) Metal fibre
12) Wisker (potassium titanate, aluminium nitride, alumina)

The above nonionic surfactants are listed below.

Esters of fatty acid with polyethylene glycol, esters of fatty acid with polyoxyethylene sorbitan, polyoxy ethylene aliphatic ethers, polyoxyethylene alkylphenyl ethers, esters of fatty acid with polyoxyethylene glycerin, polyoxyethylenealiphatic amines, monoesters of fatty acid with sorbitan, esters of fatty acid with pentaerythritol, adducts of aliphatic alcohols with ethylene oxides, adducts of fatty acids with ethylene oxide, adducts of aliphatic amines or aliphatic amides with ethylene oxide, adducts of fatty acids with ethylene oxide, adducts of alkylphenols with ethylene oxides, adducts of alkylnaphthols with ethylene oxides, adducts of partial fatty acid esters of polyhydric alcohols with ethylene oxides, various nonionic anti-static agents disclosed on page 120 of Japanese Patent Publication No. 63-26697/1988.

The above anionic surfactants are listed below.

Ricinoleic acid surfuic acid ester sodium salts, various fatty acid metal salts, ricinoleic acid ester surfuic acid ester sodium salts, sulfo oleic acid ethylaniline, olefin sufuric acid ester salts, oleyl alcohol sufuric acid ester salts, alkylsufuric acid ester salts, fatty acid ethyl sulfonic acid salts, alkysulfonic acid salts, alkylnaphthalenesulfonic acid salts, alkylbenzenesulfonic acid salts, succinic acid ester salts, phosphoric acid ester salt The above cationic surfactants are listed below.

Primary amine salts, tertiary amine salts, quaternary ammonium salts, pyridium derivatives.

The above amphoteric surfactants are listed below.

Carboxylic acid derivatives, imidazoline derivatives, betaine derivatives.

Antioxidants may be preferably added in order to prevent occurrence of fish eye or non-uniform fault.

The above antioxidants are listed below.

(a) Phenol type antioxidants 6-t-butyl-3-methylphenol derivatives, 2,6-t-butyl-p-cresol, t-butylphenol, 2,2'-methylenebis(4-ethyl-6-t-butylphenol), 4,4'-butylidenebis(6-t-butyl-m-cresol), 4,4'-thiobis(6-t-butyt-m-cresol), 4,4-dihydroxydiphenylcyclohexane, alkylated phenol, 2,6-di-t-butyl-4-methylphenol, n-octadecyl-3-(3',5'-di-t-butyl-4'-hydroxyphenyl)propionate, 2,2'-methylenebis(4-methyl-6-t-butylphenol), 4,4'-thiobis(3-methyl-6-t-butylphenol), 4,4'-butylidenebis(3-methyl-6-t-butylphenol), stearyl-β(3,5-di-4-butyl-4-hydroxyphenyl)propionate, 1,1,3-tris(2-methyl-4-hydroxy-5-t-butylphenyl)butane, 1,3,5-trimethyl-2,4,6-tris(3,5-di-t-butyl-4-hydroxybenzyl)benzene, tetrakis(methylene-3-(3',5'-di-t-butyl-4'-hydroxyphenylpropionate) methane.

(b) Ketoneamine condensation type antioxidant 6-ethoxy-2,2,4-trimethyl-1,2-dihydroquinoline, a polymer of 2,2,4-trimethyl-1,2-dihydroquinoline, trimethyldihydroquinoline derivatives.

(c) Arylamine type antioxidants phenyl-α-naphthylamine, N-phenyl-β-naphthylamine, N-phenyl-N'-isopropyl-p-phenylenediamine, N,N'-diphenyl-p-phenylenediamine, N-N'-di-β-naphthyl-p-phenylenediamine, N-(3'-hydroxybutylidene)-1-naphthylamine.

(d) Imidazol type antioxidants 2-mercaptobenzimidazole, 2-mercaptobenzimidazole zinc salt, 2-mercaptomethylbenzimidazole.

(e) Phosphite type antioxidants alkylated arylphosphite, diphenylisodecylphosphite, tris(nonylphenyl)phosphite phosphorous acid sodium salt, tri(nonylphenyl)phosphite, triphenylphosphite (f) Thiourea type antioxidants thiourea derivatives, 1,3-bis(dimethylaminopropyl)-2-thiourea.

(g) Other antioxidants useful for air oxidation prevention dilaurylthiopropionate The typical antioxidants available on the market will be shown below.

(1) Phenol anti-oxidation agents:

SUMILIZER BHT (Sumitomo), IRGANOX 1076 (Ciba-Guigy), MARK AO-50 (Adeca Argas), SUMILIZER BP-76 (Sumitomo), TOMINOX SS (Yoshitomi), IRGANOX 565 (Ciba-Guigy), NONOX WSP (ICI), SANTONOX (Monsanto), SUMILIZER WXR (Sumitomo), ANTAGE-CRYSTAL (Kawaguvhi), IRGANOX 1035 (Ciba-Guigy), ANTAGE W-400 (Kawaguvhi), NOCLIZER NS-6 (Ohuchi Shinkoh), IRGANOX 1425 WL (Ciba-Guigy), MARK AO-80 (Adeca Argas), SUMILIZER GA-80 (Sumitomo), TOPANOLCA (ICI), MARK AO-30 (Adeca Argas), MARK A0-20 (Adeca Argas), iRGANOX 3114 (Ciba-Guigy), MARK AO-330 (Adeca Argas), IRGANOX 1330 (Ciba-Guigy), CYANOX 1790 (ACC), IRGANOX 1010 (Ciba-Guigy), MARK AO-60 (Adeca Argas), SUMILIZER BP-101 (Sumitomo) and TOMINOX TT (Yoshitomi).

(2) Phosphate anti-oxidation agents:

IRGAFOS 168 (Ciba-Guigy), MARK AO-2112 (Adeca Argas), WASTON 618 (Borg Warner), MARK PEP-8 (Adeca Argas), ULTRANOX 626 (Borg Warner), MARK PEP-24G (Adeca Argas), MARK PEP-36 (Adeca Argas) and HCA (Sankoh).

(3) Thio ether anti-oxidation agents:

DLTDP "YOSHITOMI" (YOSHITOMI), SUMILIZER TPL (Sumitomo), ANTIOX L (Nichiyu), DMTD "YOSHITOMI" (YOSHITOMI), SUMILIZER TPM (Sumitomo), ANTIOX M (Nichiyu), DSTP "YOSHITOMI" (YOSHITOMI), SUMILIZER TPS (Sumitomo), ANTIOX S (Nichiyu), SEENOX 412S (SIPRO), MARK AO-412S (Adeca Argas), SUMILIZER TPD (Sumitomo), MARK AO-23 (Adeca Argas), SANDSTABP-EPQ (SAND), IRGAFOS P-EPQ FF (Ciba-Guigy), IRGAFOS 1222 (Ciba-Guigy), MARK 329K (Adeca Argas), WES TON399 (Borg Warner), MARK 260 (Adeca Argas) and MARK 522A (Adeca Argas).

(4) Metal inactivators:

NAUGARD XL-1 (UNI-ROYAL), MARK CDA-1 (Adeca Argas), MARK CDA-6 (Adeca Argas), IRGAFOS 1024 (Ciba-Guigy) and CU-NOX (Mitsui Tohatsu).

The preferable anti-oxidation agents are phenol type anti-oxidation agents. As a commercially available product, any kind of IRGAFOS (Ciba-Guigy), SUMILIZER BHT, SUMILIZER BH-76, SUMILIZERWX-R and SUMILIZER BP-101 (Sumitomo) are cited.

It is also preferable to use only one independently, or two or more of 2,6-di-tbutyl-p-crezol (BHT), low volatile high moleculr weight phenol anti-oxidation agents (product names: Irganox 1010, Irganox 1076, Topanol CA and Ionox 330), dilaulyl thiopropionate, distealyl thiopropionate and dialkylphosphate, in combination.

In addition, any anti-oxidation agent disclosed in the Plastic Handbook (published by Industrial Investigation Association), on pp. 794 to 799 and any anti-oxidation agent disclosed in Data on Plastic Additives (Chemical Industrial Co., Ltd.), pp. 327 through 329 and any anti-oxidation agent disclosed in Plastics Age Encyclopedia Advance Edition 1986 (Plastic Age Co., Ltd.), on pp. 211 through 212 can be selected and used.

With regard to the added amount of the above-mentioned additives, in the case of slipping agent, 0.5 to 3.0 weight % is preferable. When exceeding 3 weight %, the layer surface physical properties are changed including poor dispersion and exudation. In the case of 0.4 weight % or less, no desirable effects are provided.

In the case of an anti-static agent, the preferred amount is 2.0 to 4.0 weight %. When exceeding 4.0 weight %, adverse effects occur in the lubricant property of the heat seal and the film. In the case of 1.9 weight % or less, an anti-static effect cannot be provided.

In the case of an anti-oxidation agent, the preferred amount is 0.01 to 1.0 weight %. When exceeding 1.0 weight %, abnormalities occur in photographic performance such as fogging and increase/decrease of sensitivity. In the case of 0.01 weight % or less, effect of adding is not substantially provided. Therefore, it is preferable to add the anti-oxidation agent in the minimum amount which does not cause fish eye and/or dots.

As a dispersant used for the present invention, phosphoric acid ester, alkyl sulfate, high class alcohols, polyethylene oxide, high class fatty acid salt, sulfosuccinic acid, sulfosuccinic acid ester and conventional surfactants and their salts are cited. In addition, salts of polymer dispersants having an anionic organic group (for example, —COOH) can also be used. These dispersants can be used independently, or two or more thereof can be used in combination.

EXAMPLES

Hereunder, practical examples of the present invention will be explained. However, the embodiment of the present invention is not limited thereto.

(EXAMPLE 1)

A light-shielding film wherein a layer a, a layer b and a layer c was laminated in this order was prepared by means of a co-extrusion inflation method.

| | |
|---|---|
| Layer a: HF-110 produced by Mitsubishi Kasei (HDPE) (conventional catalyst) | 90 weight % |
| Carbon black (product name: PEX986020 produced by Tokyo Ink Co., Ltd.) | 10 weight % |
| Thickness | 24 μ |
| Layer b: Moretec 0128N produced by Idemitsu Sekiyu Kagaku, Co., Ltd.(conventional catalyst) | 40 weight % |
| HF-110 produced by Mitsubishi Kasei Co. Ltd. (conventional catalyst) | 40 weight % |
| Carbon black (product name: PEX9860 20 produced by Tokyo Ink Co., Ltd.) | 20 weight % |
| Thickness | 60 μ |
| Layer c: Mixture of LDPE (60 weight (Metallocene catalyst) and LLDPE (40 weight %) (Metallocene catalyst) | 83 weight % |
| Carbon black.(product name: PEX986020 produced by Tokyo Ink Co., Ltd.) | 11 weight % |
| Slipping agent (product name: BB35, produced by Idemitsu Sekiyu Kagaku Co., Ltd.) | 3 weight % |
| Anti-static agent (product name: PEX1385, produced by Tokyo Ink) | 3 weight % |
| Thickness | 24 μ |

Incidentally, the layer c is a heat seal layer. Table 1 shows a content (weight %) of a resin of a molecular weight of 30,000 or less in the layer c. In a comparative sample, the following LDPE and LLDPE which were prepared by the use of the conventional catalyst (Ziegler-Natta cataryst) were used in layer c.

TABLE 1

LLDPE: Moretec V-0398CN produced by Idemitsu Sekiyu Kagaku Co., Ltd.
LDPE: Herotrocene 172 produced by Toso

| Sample No. | LLDPE | LDPE |
|---|---|---|
| 1 | 0.3 | 1.0 |
| 2 | 0.5 | 1.5 |
| 3 | 1.0 | 1.0 |
| 4 | 1.5 | 0.5 |
| 5 | 2.0 | 0.5 |
| 6 | Comparative sample | |

Molecular weight was measured by a GPC (Gel Permeation Chromatography) method.

The three sides of two sheets of the film were heat sealed with layer c inside so that an envelope for a sheet light-sensitive material was prepared. Inside this envelope, 40 sheets of X-ray light-sensitive materials (Konica Medical Imaging Film LP-633, produced by Konica Corporation) were inserted and sealed tightly by heat.

Table 2 shows the most appropriate heat sealing temperature.

TABLE 2

| Sample No. | Heat Seal Temperature (°K.) |
|---|---|
| 1 | 100 |
| 2 | 100 |
| 3 | 95 |
| 4 | 95 |
| 5 | 115 |
| 6 | 125 |

After sealing tightly, the light-sensitive materials were left for one year at temperature of 25° C. and humidity of 65% RH, and then, subjected to wedge exposure to light. Following this, the blue density and sensitivity change of unexposed portions of the resulting materials were measured. Table 3 shows the results thereof.

TABLE 3

| Sample No. | Density (%) | Sensitivity |
|---|---|---|
| 1 | ±0 | −1.0 |
| 2 | ±0 | −1.0 |
| 3 | ±0 | −1.0 |
| 4 | ±0 | −1.0 |
| 5 | ±0 | −1.0 |
| 6 | +40 | −10 |

Each value in the above-mentioned Table is a change rate to that of the light-sensitive materials which were frozen and stored, and then, subjected to exposure to light and photographic processing under the same conditions as above.

From the above-mentioned results, it can be understood that adverse effects on the light-sensitive materials can be prevented by the use of resin of the present invention.

Incidentally, for measuring, a densitometer Model PDA65, produced by Konica Corporation, and a blue filter were used.

In addition, even when LLDPE was used instead of the mixture of LDPE and LLDPE in the layer c, the results were the same. In addition, even when resins in layers a and b were replaced with resins using a metallocene catalyst and the content of lower molecular weight resin ratio was reduced to 0.3% or less, the results were still the same.

EXAMPLE 2

Samples No. 7 through 12 were prepared in the same manner as in Example 1 except that the thickness of each layer of Example 1 was changed as follows:

Layer a: 10μ

Layer b: 40μ

Layer c: 10μ and craft paper whose weight was 35 g/m$^2$ was laminated using an adhesive on the uppermost layer (above layer "a") of the samples used in Example 1, and subjected to the same storage test.

Incidentally, for a light-sensitive material, color paper was used. After leaving, the color paper was subjected to designated processing, and then, the blue density of an unexposed portions of the resulting color paper was measured. Table 4 shows the difference of density with a comparative sample.

TABLE 4

| Sample No. | Difference of density |
|---|---|
| 7 | +0.01 |
| 8 | +0.01 |
| 9 | +0.00 |
| 10 | +0.00 |
| 11 | +0.05 |
| 12 | +0.10 |

Incidentally, a comparative sample is the same color paper as that used in the test, wherein it was frozen and stored, and then, subjected to photographic processing concurrently.

From the above-mentioned results, it can be understood that adverse influence on the color paper can be prevented by the use of the resin of the present invention.

The density was measured by the use of a densitometer Model PDA 65, produced by Konica Corporation, and a blue filter.

EXAMPLE 3

A multilayered film wherein layers a', layer b' and layer c' were laminated in this order was formed by the use of a three-layer-co-extrusion method. Table 5 shows thickness, the type of material added and the amount (%) of the added material for each layer.

TABLE 5

| Layer | Layer thickness (μm) | Additive | Added amount (weight %) | Remarks |
|---|---|---|---|---|
| a' | 37 | Light-reflective material | 15.0 | Outermost layer |
| b' | 50 | Light-reflective material | 15.0 | — |
| c' | 13 | Light-absorption material | 20.0 | Heat-sealed layer |

"Added amount" of the additive means the added amount to a master batch.

Light-reflective material

Titanium oxide PEX6800 produced by Tokyo Ink Co., Ltd.

Light-absorption material

Carbon black PEX9860 20 produced by Tokyo Ink Co., Ltd.

A constitution for each layer was as follows:

I. Layer a': High density polyethylene (HDPE) whose density was 0.942 g/cm$^3$ and melt flow rate was 0.03 g/10 minutes.

Layer b': High density polyethylene used in layer (a) of 80 weight % and straight-chained low density polyethylene (LLDPE) with a density of 0.915 g/cm$^3$ and melt flow rate of 1.30 g/10 minutes of 20 weight %.

Layer c': Straight-chained low density polyethylene (LLDPE) at density of 0.907 g/cm$^3$ and melt flow rate of 3.30 g/10 minutes of 40 weight %, and low density polyethylene (LLDPE) wherein density of 0.920 g/cm$^3$ and a melt flow rate of 0.3 g/10 minutes of 60 weight %.

Layer c' is a heat seal layer.

Sample Nos. 13 through 18 were obtained by changing the above-mentioned resins as follows.

TABLE 6

| Sample No. | Layer a HDPE | Layer b LLDPE | Layer c LLDPE | Layer c LPPE (4:6) |
|---|---|---|---|---|
| 13 | Resin produced by the use of a metallocene catalyst | Equivalent to the left | Equivalent to the left | Equivalent to the left |
| 14 | Resin produced by the use of a conventional catalyst | Equivalent to the left | Resin produced by the use of a metallocene catalyst | Equivalent to the left |
| 15 | Resin produced by the use of a conventional catalyst | Equivalent to the left | Resin produced by the use of a metallocene catalyst | Equivalent to the left |
| 16 | Resin produced by the use of a conventional catalyst | Equivalent to the left | Resin produced by the use of a metallocene catalyst | Equivalent to the left |
| 17 | Resin produced by the use of a conventional catalyst | Equivalent to the left | Resin produced by the use of a metallocene catalyst | Equivalent to the left |
| 18 | Resin produced by the use of a conventional catalyst | Equivalent to the left | Equivalent to the left | Equivalent to the left |

The content ratio (weight %) of a low molecular weight resin contained in the resins used in each layer is shown as follows:

TABLE 7

| Sample No. | Layer a HDPE | Layer b LLDPE | Layer c LLDPE | Layer c CDPE |
|---|---|---|---|---|
| 13 | 1.5 | 1.0 | 1.0 | 0.5 |
| 14 | 7.0 | 4.5 | 0.09 | 0.1 |
| 15 | 6.0 | 5.0 | 0.5 | 1.0 |
| 16 | 4.5 | 6.0 | 2.5 | 0.5 |
| 17 | 6.0 | 4.0 | 0.5 | 2.5 |
| 18 | 4.0 | 5.0 | 5.0 | 5.0 |

To layer c, the following additives were added.

Slipping agent: Stearic acid amido type lubricant 0.7 weight %

Anti-static agent: Polyoxyethylene aliphatic alcohol ether 2.3 weight %

On the layer "a" side of each sample, a polyester resin film having a thickness of 1.2μ was laminated by the use of adhesive agents KW-40 and LX-75A produced by DaiNippon ink Co., Ltd. so that the final sample was prepared.

Each sample was formed into an envelope by means of a heat sealing (140° C., 1 second), and then, an un-enclosed color film (Konica color XG-400) was inserted into the envelope in a dark room. The envelope was sealed tightly. After it was left for one year at temperature of 25° C. and humidity of 60% RH, the film was subjected to color film photographic processing designated by Konica, and then, the density of the resulting film was measured with a densitometer.

Densitometer used: Densitometer Model PDA 65 produced by Konica Corporation

The following Table shows the measurement results of blue density.

TABLE 8

| Sample No. | Change of density |
|---|---|
| 13 | +0.04 |
| 14 | +0.03 |
| 15 | +0.04 |
| 16 | +0.02 |
| 17 | +0.03 |
| 18 | +0.10 |

The same films used in the testing were frozen and stored, and then, subjected to photographic processing concurrently with the tested films. The resulting films were defined to be comparative films. The above-mentioned numerals shows the difference of density between the tested films and the comparative films.

From the above-mentioned results, the effectiveness of the present invention was confirmed.

EXAMPLE 4

Samples of Example 3 were prepared by means of a dry lamination method.

Incidentally, in this occasion, adhesive agents KW-40 and LX-75A, produced by DaiNippon Ink Co., Ltd. respectively, were mixed in a ratio of 2:1 so that an adhesive agent was prepared. The resulting agent was used.

The films were tested and evaluated under the same testing conditions as in Example 3 for evaluation. As a result, the same results as shown in Example 3 were obtained.

EXAMPLE 5

The envelope for storing a photographic film was prepared using the follwing polyethylene film samples:

Sample 19

A film consisting of 94 weight % of low density straight-chained polyethylene (prepared using a conventional Ziegler-Natta catalyst) having a density of 0.907 g/cm$^3$ and a melt flow rate of 3.30 g/10 minutes and 6 weight % of carbon black Sample 20

A film consisting of 94 weight % of low density straight-chained polyethylene (prepared using a metallocene catalyst) having a density of 0.907 g/cm$^3$ and a melt flow rate of 3.30 g/10 minutes and 6 weight % of carbon black Each of the above films was folded, the two opposing open side end portions were heat sealed for one second at 140° C. to obtain an envelope. A color film (Konica Color XG-400) was incorporated in each of the envelopes from an open section, and tightly sealed applying heat for one second at 140° C. The resulting envelope was stored for 15 days at 55° C. Thereafter, the films were removed from the envelope, and were processed in accordance with the specified process. The resulting films were evaluated for a blue density. The density was measured using a densitometer PDA Type 65 produced by Konica Corporation. The results are shown in Table 9. The change of density was measured in the same manner as in Example 3.

TABLE 9

| Sample No. | Change of Density | Remarks |
|---|---|---|
| 19 | +0.08 | Comparative |
| 20 | +0.02 | Invention |

As is apparent from Table 9, the sample of the invention gives superior storage stability of the photographic film.

EXAMPLE 6

A 110 film cartridge shown in FIG. 1 was prepared.

In the figure, a cartridge is composed of a 110 cartridge body 1 and cartridge cover 2. Inside the body 1, a film is loaded. Cover 2 is subjected to heat sealing. Thus, cartridge 3 is completed. The portions X refer to as heat sealed portions.

As a resin used for preparing the above-mentioned cartridge, a polystyrene resin was used.

Sample 21: Polystyrene resin produced by the use of a conventional catalyst, the resin having a density of 1.05, a melt flow rate of 8.8 g/10 minutes, and the resin contained a resin having a molecular weight of 20,000 or less in an amount of 6 weight %.

Sample 22: Resin of the present invention Polystyrene resin produced by the use of a metallocene catalyst, the resin having a density of 1.05, a melt flow rate of 8.8 g/10 minutes and the resin contained a resin having a molecular weight of 20,000 or less in an amount of 0.8 weight %.

TABLE 10

| Sample No. | Sealing temperature (°C.) |
|---|---|
| 21 | 100 |
| 22 | 81 |

The above-mentioned cartridges were inserted in a tightly sealed container made of resin which was confirmed to have no influence on photographic performance one by one. The containers were left for one year in a dark room at temperature of 25° C. and humidity of 65% RH. Following this, the films in the above-mentioned cartridge were subjected to designated photographic processing, and then, the density of the resulting films was compared with that of the standard film. Table 10 shows the results of the density change.

TABLE 11

| Sample No. | Density change |
|---|---|
| 21 | +0.07 |
| 22 | +0.02 |

Incidentally, the standard film is defined to be a film which is the same as those used in the present testing and which was frozen and stored, and then, subjected to photographic processing concurrently with the present testing films. In addition, density was measured by the use of a densitometer Model PDA 65, produced by Konica Corporation, by the use of a blue filter. The above-mentioned values represent difference with the standard film.

Also, from the above-mentioned result too, it can be understood that the sample of the present invention which has a low content of low molecular weight resin and which can be subjected to heat sealing at low temperature is excellent in terms of storage stability.

The molecular weight was measured by means of a GPC method in the same manner as in Example 1.

What is claimed is:

1. A photographic package comprising:

a photographic light sensitive material; and a container in which the photographic light sensitive material is accommodated, the container comprising at least one heat seal layer and being sealed by applying heat to the heat seal layer, wherein the heat seal layer comprises a polymer resin prepared by polymerizing an ethylenically unsaturated monomer in the presence of a metallocene catalyst, the polymer resin being a polyethylene containing a polyethylene of a molecular weight of 30,000 or less in an amount of 3 weight % or less or a polystyrene containing a polystyrene of a molecular weight of 20,000 or less in an amount of 3 weight % or less.

2. The photographic package of claim 1, wherein the container has a flexible film and the heat seal layer provided thereon.

* * * * *